US006480162B2

(12) United States Patent
Sabet et al.

(10) Patent No.: US 6,480,162 B2
(45) Date of Patent: Nov. 12, 2002

(54) LOW COST COMPACT OMINI-DIRECTIONAL PRINTED ANTENNA

(75) Inventors: Kazem F. Sabet, Ann Arbor, MI (US); Kamal Sarabandi, Ann Arbor, MI (US); Linda P. B. Katehi, Northville, MI (US); Panayiotis Frantzis, Ann Arbor, MI (US)

(73) Assignee: EMAG Technologies, LLC, Ann Arbor, MI (US)

( * ) Notice: Subject to any disclaimer, the term of this patent is extended or adjusted under 35 U.S.C. 154(b) by 0 days.

(21) Appl. No.: 09/758,955

(22) Filed: Jan. 11, 2001

(65) Prior Publication Data

US 2002/0000944 A1 Jan. 3, 2002

Related U.S. Application Data

(60) Provisional application No. 60/175,790, filed on Jan. 12, 2000.

(51) Int. Cl.[7] ..... H01Q 13/10

(52) U.S. Cl. ..... 343/767; 343/770

(58) Field of Search ..... 343/767, 769, 343/776, 743, 866, 700 MS, 770, 788, 895, 751, 742; H01Q 13/10

(56) References Cited

U.S. PATENT DOCUMENTS

| | | | | |
|---|---|---|---|---|
| 2,863,145 A | * | 12/1958 | Turner | 343/767 |
| 3,031,665 A | * | 4/1962 | Robert-Pierre Marie | 343/770 |
| 3,638,226 A | * | 1/1972 | Brooks et al. | 343/895 |
| 4,313,120 A | * | 1/1982 | Westerman | 343/771 |
| 4,672,386 A | * | 6/1987 | Wood | 343/770 |
| 4,839,663 A | | 6/1989 | Kurtz | 343/771 |
| 5,068,670 A | | 11/1991 | Maoz | 343/767 |
| 5,087,922 A | | 2/1992 | Tang et al. | 343/814 |
| 5,155,493 A | | 10/1992 | Thursby et al. | 343/700 MS |
| 5,194,876 A | | 3/1993 | Schnetzer et al. | 343/769 |
| 5,353,035 A | * | 10/1994 | Del Castillo Cuervo-Arango et al. | 343/700 MS |

(List continued on next page.)

FOREIGN PATENT DOCUMENTS

| | | | |
|---|---|---|---|
| JP | 10 135727 | 8/1998 | H01Q/13/10 |
| WO | WO 98 49742 | 11/1998 | |

OTHER PUBLICATIONS

Nurnberger, M.W. et al., "A New Planar Feed for Slot Spiral Antennas", IEEE Transactions on Antennas and Propagaton, US, IEEE Inc, New York, vol. 44, No. 1, 1996, pp. 130–131.

Nakano, H., et al., "Two–Arm Slot Spiral Antenna", Electromagnetics, Hemisphere Publishing Co., vol. 14, No. 3/04, Jul. 1, 1994, pp. 397–413.

Hirose, K., et al., "Monofilar Archimedean Spiral Slot Antennas", Electromagnetics, Hemisphere Publishing Co., vol. 14, No. 3/04, Jul. 1, 1994, pp. 415–426.

*Primary Examiner*—Don Wong
*Assistant Examiner*—Trinh Vo Dinh
(74) *Attorney, Agent, or Firm*—John A. Miller; Warn, Burgess & Hoffman, P.C.

(57) ABSTRACT

An omni-directional printed antenna that includes at least two wound slot antenna elements. The spacing between the elements, the lengths of the elements and the feed location of the elements are selected to provide a desirable electromagnetic coupling between the elements that causes the narrow bandwidth of the individual elements to combine into a wide bandwidth while providing an omni-directional radiation pattern. Winding the elements together in this manner also allows different antennas for different frequency bands to be combined as a single antenna in a small space. Further, the printed antenna can be patterned on a copper tape to create a sticker type antenna that can be readily mounted on different surfaces.

18 Claims, 9 Drawing Sheets

U.S. PATENT DOCUMENTS 5,489,913 A * 2/1996 Raguenet et al. ..... 343/767
5,519,408 A * 5/1996 Schnetzer ..... 343/767
5,530,358 A * 6/1996 Wisler et al. ..... 324/338
5,539,420 A 7/1996 Dusseux et al. ..... 343/769
5,568,159 A * 10/1996 Pelton et al. ..... 343/767
5,706,015 A 1/1998 Chen et al. ..... 343/700 MS
5,714,961 A * 2/1998 Kot et al. ..... 343/769
5,748,153 A * 5/1998 Mckinzie, III et al. ..... 343/767
5,808,586 A 9/1998 Phillips et al. ..... 343/895
5,892,480 A 4/1999 Killen ..... 343/895
5,914,693 A 6/1999 Takei et al. ..... 343/767
5,929,825 A 7/1999 Niu et al. ..... 343/895
6,023,214 A 2/2000 Ohta et al. ..... 336/84 R
6,052,093 A * 4/2000 Yao et al. ..... 343/770
6,081,239 A 6/2000 Sabet et al. ..... 343/753
6,373,436 B1 * 4/2002 Chen et al. ..... 343/702

* cited by examiner

LOW COST COMPACT OMINI-DIRECTIONAL PRINTED ANTENNA

CROSS REFERENCE TO RELATED APPLICATIONS

Applicant hereby claims benefit of U.S. Provisional Application No. 60/175,790, titled Low Cost Compact Omni-Directional Printed Antenna, filed Jan. 12, 2000.

BACKGROUND OF THE INVENTION

1. Field of the Invention

This invention relates generally to a printed antenna, and, more particularly, to a planar printed slot antenna that includes two or more curved antenna elements interlaced to reduce the overall size of the antenna, where the spacing, feed locations, and length of the elements are selected to electromagnetically couple the elements to increase the antenna's bandwidth and achieve an omni-directional radiation pattern.

2. Discussion of the Related Art

There is a growing demand for wireless communications services, such as cellular telephone, personal communications systems (PCS), global positioning systems (GPS), etc. With this demand there is a need for low-cost miniaturized planar antennas. The multitude of wireless services requires multiple antennas to cover different frequency bands and functions. Also, the demand for dualband phones is ever growing as people increasingly tend to use both analog and digital communications services. Further, both cellular phone and PCS antennas require an omni-directional pattern.

Additionally, it is desirable that the size of the communication apparatus and the transmitting or receiving antennas be small. This becomes even more of a necessity when multiple antennas have to be mounted in a limited area. In military applications, a small antenna size is critical for low radar visibility, and to increase system survivability. In commercial applications, small size alleviates problems with styling, vandalism and aerodynamic performance. Size reduction is especially useful in low frequency applications in the HF, VHF, UHF and L frequency bands ranging from 30 to 3000 MHz. The wavelengths in these bands range from 1 km to 10 cm. Considering the fact that a resonant dipole is about a half-wavelength long, the motivation behind size reduction is obvious.

For low frequency applications, low-profile printed antennas include printed microstrip dipole and printed slot antennas. Printed antennas essentially comprise a printed circuit board with a trace layout. The trace layouts can be made using chemical etching, milling or other known methods. These antennas enjoy a host of advantages including ease of manufacture, low cost, low profile, conformality, etc.

U.S. Pat. No. 6,081,239 issued Jun. 27, 2000 to Sabet et al. discloses a planar printed antenna that employs a high dielectric superstrate lens having a plurality of air voids that set the effective dielectric constant of the material of the lens to reduce resonant waves in the lens, thus reducing power loss in the antenna. The superstrate with air voids allows the size of the dipoles or slots to be reduced for any particular frequency band.

FIGS. 1(*a*) and 1(*b*) show a known slot antenna 10 including a metallized ground plane 16 and microstrip feed line 12 printed on opposite sides of a printed circuit board (PCB) 14. A linear slot element 18 is cut out of the ground plane 16 by a suitable etching step or the like. The microstrip line 12 is connected to the ground plane 16 at the edge of the slot element 18 by a shorting pin 20 extending through the circuit board 14.

It is possible to reduce the area occupied by a linear antenna element 22 by bending or winding the antenna element 22 into a curved or twisted shape, as shown in FIGS. 2(*a*) and 2(*b*). However, bending the antenna element 22 immediately results in a sharp reduction of its bandwidth. This can be verified by numerical modeling and computer simulation.

FIG. 3 shows the effect of gradually bending a slot antenna element 24 and how it affects the antenna bandwidth, near field, and vertical and horizontal polarization. This simulation shows that more windings result in a more omni-directional antenna pattern, but the bandwidth of the antenna element 24 is reduced.

A wound slot antenna element has to be fed at a location close to its end because the input impedance at its center is very high. The antenna element can be fed using a microstrip line printed on the other side of the substrate with a matching extension or a shorted via hole, as shown in FIGS. 1(*a*) and 1(*b*). A coaxial cable can also be used, where its outer conductor is connected to the ground area of the slot antenna and its inner conductor is shorted through the slot.

As discussed above, an antenna design challenge is to increase or maintain the bandwidth of a printed antenna while at the same time reducing the size of the antenna by winding the antenna elements. It is therefore an object of the present invention to provide an omni-directional printed antenna that has these advantages.

SUMMARY OF THE INVENTION

In accordance with the teachings of the present invention, an omni-directional printed antenna is disclosed that includes at least two wound slot antenna elements on a small ground plane. The spacing between the elements, the lengths of the elements and the feed location of the elements are selected to provide a desirable electromagnetic coupling between the elements that causes the narrow bandwidth of the individual elements to combine into a wide bandwidth, while retaining an omni-directional radiation pattern. Winding the elements together in this manner also allows separate antennas for different frequency bands to be combined as a single multi-band antenna in a small location. Further, the printed antenna can be patterned on a copper tape or foil to create a sticker type antenna that can be readily mounted on non-planar surfaces. The antenna can also be deposited as a conductive coating on a high permittivity ceramic to further reduce the antenna size.

Additional objects, advantages, and features of the present invention will become apparent from the following description and appended claims, taken in conjunction with the accompanying drawings.

DETAILED DESCRIPTION OF THE PREFERRED EMBODIMENTS

The following discussion of the preferred embodiments directed to a multi-trace antenna design having increased bandwidth and an omni-directional pattern is merely exemplary in nature, and is in no way intended to limit the invention or its applications or uses.

Figure 1A:
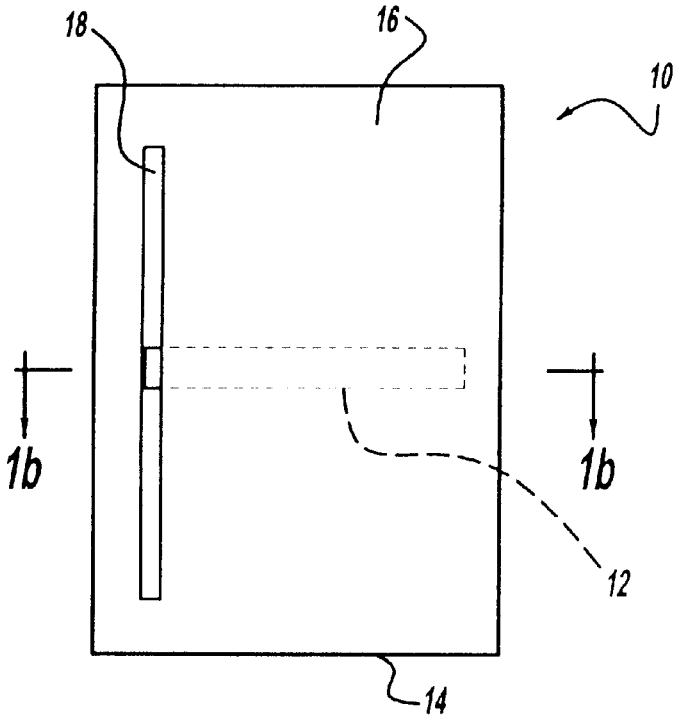
Figure - 1a Prior Art
FIGS. 1(*a*) and 1(*b*) show a conventional printed slot antenna having a microstrip feedline.
Figure 1B:
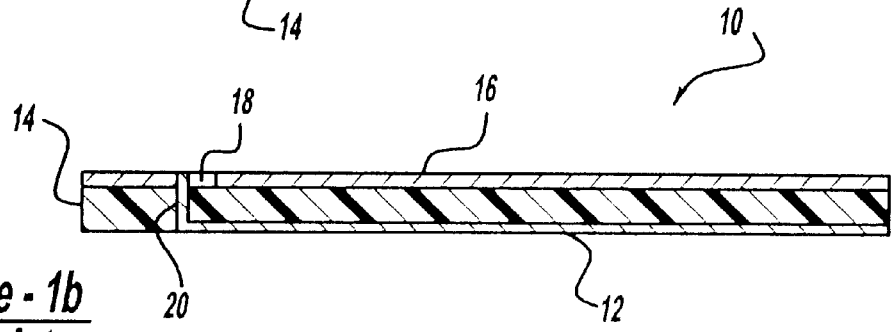
Figure - 1b Prior Art
Figure 2A:
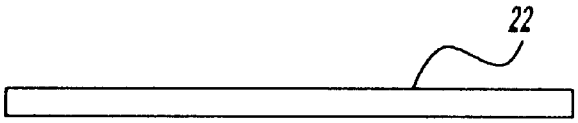
FIGS. 2(*a*) and 2(*b*) show bending a printed antenna element to reduce the antenna size.
Figure 2B:
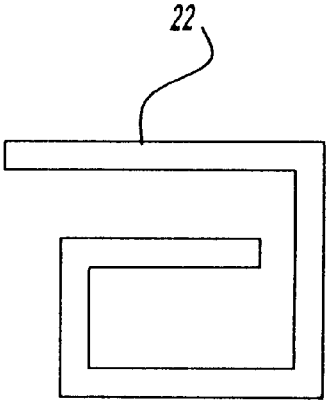
Figure 3:
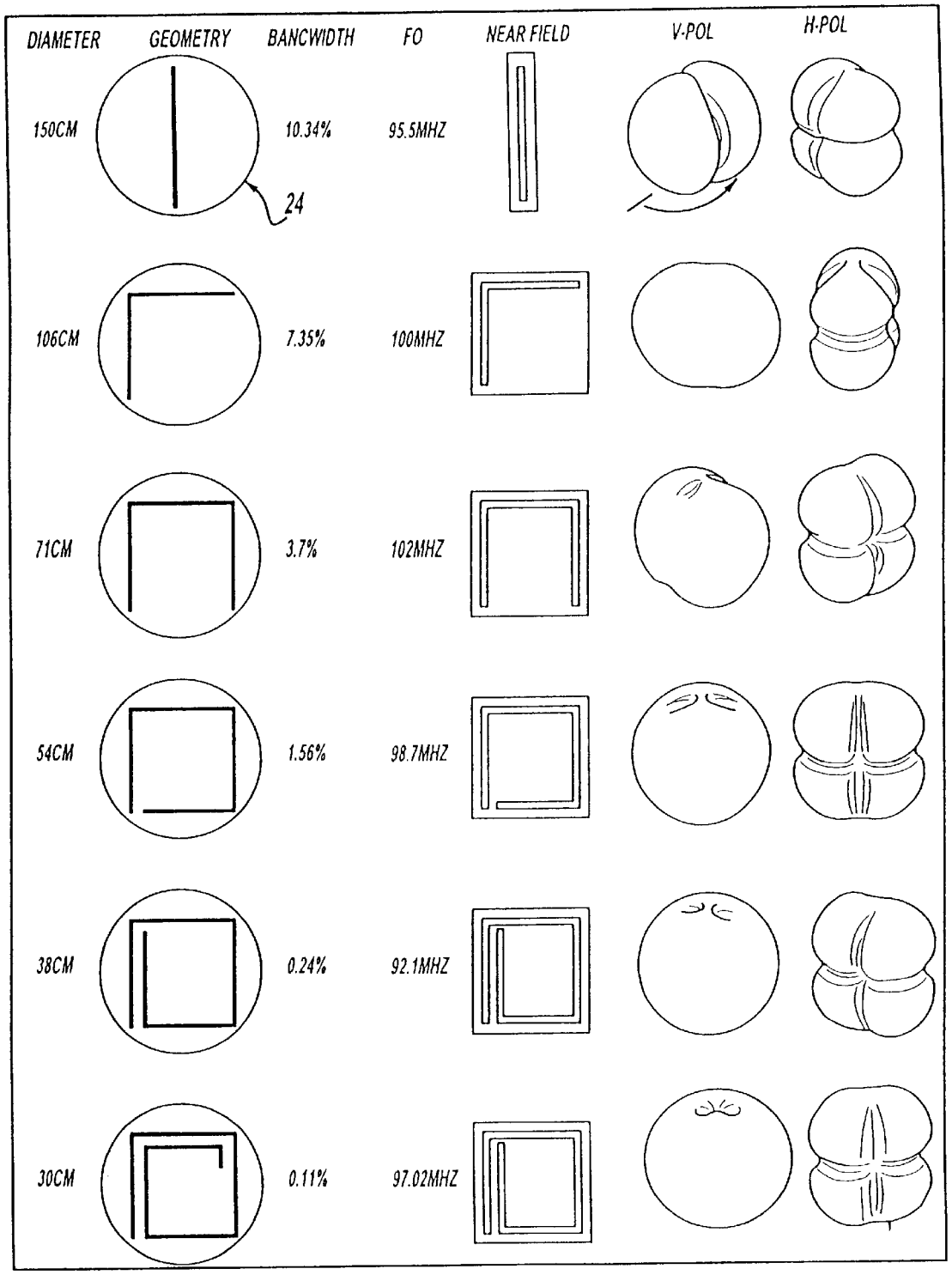
FIG. 3 shows a series of slot antennas that depict the effect of bending the antennas on the reduction of bandwidth.
Figure 4:
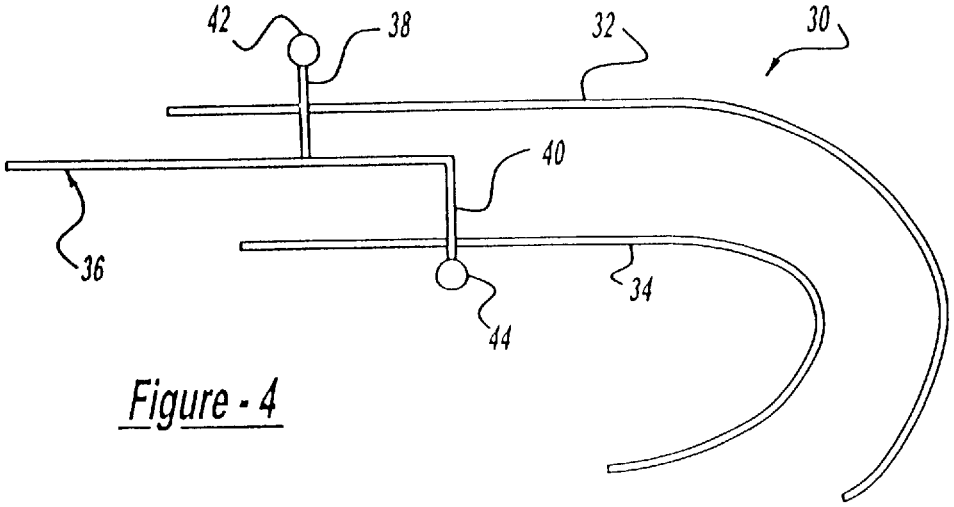
FIG. 4 is a plan view of a multi-trace antenna design, according to an embodiment of the present invention.

To overcome the limitations of reduced bandwidth for a curved or wound antenna design, the present invention proposes a multi-trace antenna design consisting of two or more slot antenna elements of different lengths configured in a relatively parallel orientation. FIG. 4 shows a schematic diagram of a printed antenna 30 having such a design, where the printed circuit board is removed for clarity. The antenna 30 includes two wound, resonating slot elements 32 and 34 that represent slots etched in a ground plane, such as the ground plane 16 above, formed on a printed circuit board, such as the printed circuit board 14. A feed line 36, that is a conductive microstrip patterned on an opposite surface of the printed circuit board, includes a feed stub 38 that feeds the element 32 and a feed stub 40 that feeds the element 34. The feed stub 38 is connected to a shorting via 42 that extends through the printed circuit board and is shorted to the ground plane on the opposite side of the printed circuit board proximate to the element 32, as shown. Likewise, the feed stub 40 is connected to a shorting via 44 that extends through the printed circuit board and is shorted to the ground plane proximate to the element 34, as shown.

As will be discussed in greater detail below, the reasonating elements 32 and 34 are coupled to produce a desired wide bandwidth. In alternate embodiments, more than two wound antenna elements can be coupled together within the scope of the present invention.

Each slot element 32 and 34 resonates at its resonant frequency proportional to its physical length, but with limited bandwidth. However, the overall antenna 30 exhibits a multi-resonant response from the combination of the resonant frequencies for both elements 32 and 34. Because of electromagnetic coupling between the adjacent slot elements 32 and 34, the overall response of the multi-trace antenna 30 is not a simple superposition of the individual responses. By properly adjusting the spacing between the dipole elements 32 and 34, their physical lengths and the feed location of each, it is possible to achieve different multi-band frequency responses with distinct resonant peaks. This can be done through a computer simulation and optimization. For a wide-band operation, the electromagnetic coupling between the neighboring slot elements can be exploited to fill the gaps between the resonant peaks, and thus broaden the bandwidth.

Figure 5A:
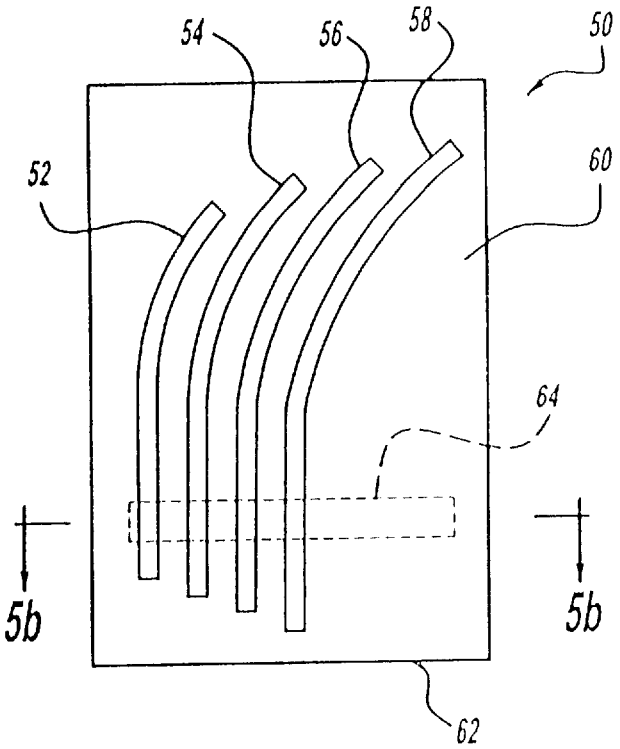
FIGS. 5(*a*) and 5(*b*) show a top view and a cross-sectional view, respectively, of a double slot antenna and its feed, according to the invention.
Figure 5B:
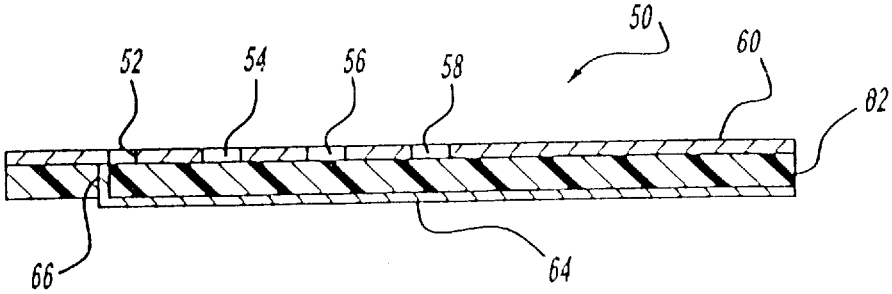

FIGS. 5(*a*) and 5(*b*) provide further support of the invention as to how tightly coupled slot elements can increase the antenna's effective bandwidth. FIGS. 5(*a*) and 5(*b*) show an antenna 50 that is a modification of the dipole antenna 10 discussed above having four slot elements 52, 54, 56 and 58. The antenna 50 includes a small ground plane 60 patterned on one side of a printed circuit board 62, and a microstrip 64 patterned on an opposite surface of the printed circuit board 62. The slot elements 52, 54, 56 and 58 are etched out of the ground plane 60. The microstrip 64 is connected to a vertical via 66 that extends through the printed circuit board 62 and is shorted to the ground plane 60 proximate the slot element 52.

In this configuration, the microstrip line 64 feeds the slot elements 52, 54, 56 and 58. Each slot element resonates at its own resonant frequency, which depends on the length of the element. Due to the tight coupling between the four elements, the overall bandwidth of the printed antenna 50 is increased. The length of the elements 52, 54, 56 and 58, the feed location of the vertical via 66 and the spacing between the slot elements 52, 54, 56 and 58 are selectively controlled to control the bandwidth as well as the resulting radiation pattern.

Figure 6A:
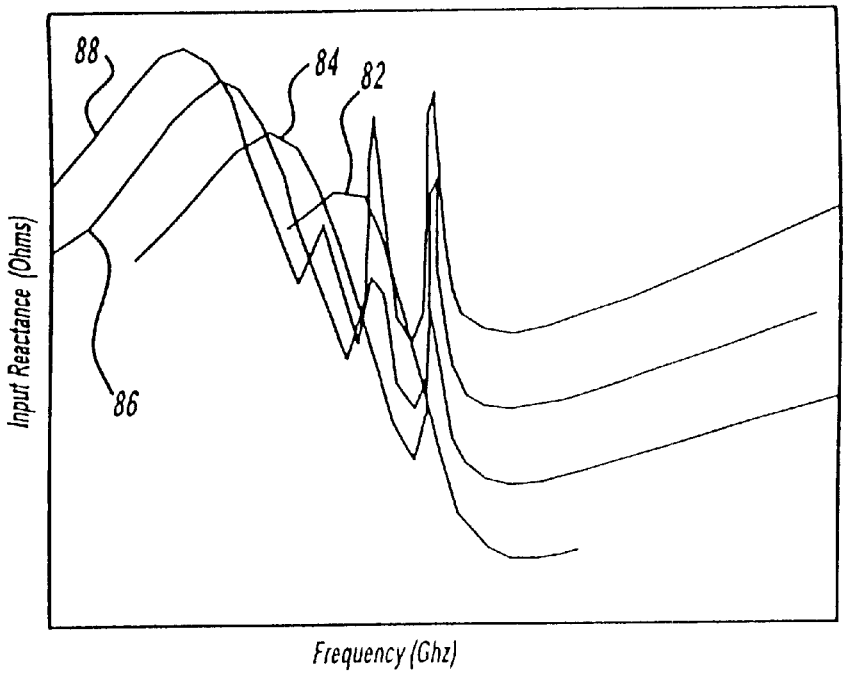
FIGS. 6(*a*) and 6(*b*) show two graphs of the input impedance behavior of a multi-slot antenna of the invention.
Figure 6B:
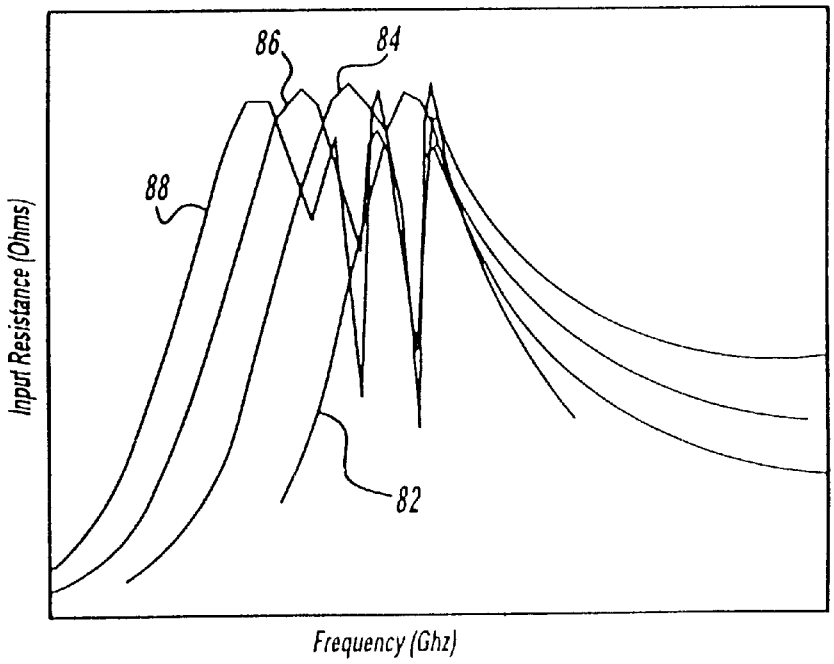

FIGS. 6(*a*) is a graph with frequency on the horizontal axis and input reactance on the vertical axis, and FIG. 6(*b*) is a graph with frequency on the horizontal axis and input resistance on the vertical axis showing the bandwidth performance of antenna 50 for various combinations of the elements 52–58. Particularly, graph line 82 is for the antenna 50 with only slot element 52 present, graph line 84 is for the antenna 50 with slot elements 52 and 54 present, graph line 86 is for the antenna 50 with slot elements 52, 54 and 56 present, and graph line 88 is for the antenna 50 with all four slot elements present. As is apparent, improved bandwidth performance is achieved by tightly coupling more slot elements of different lengths.

Figure 7:
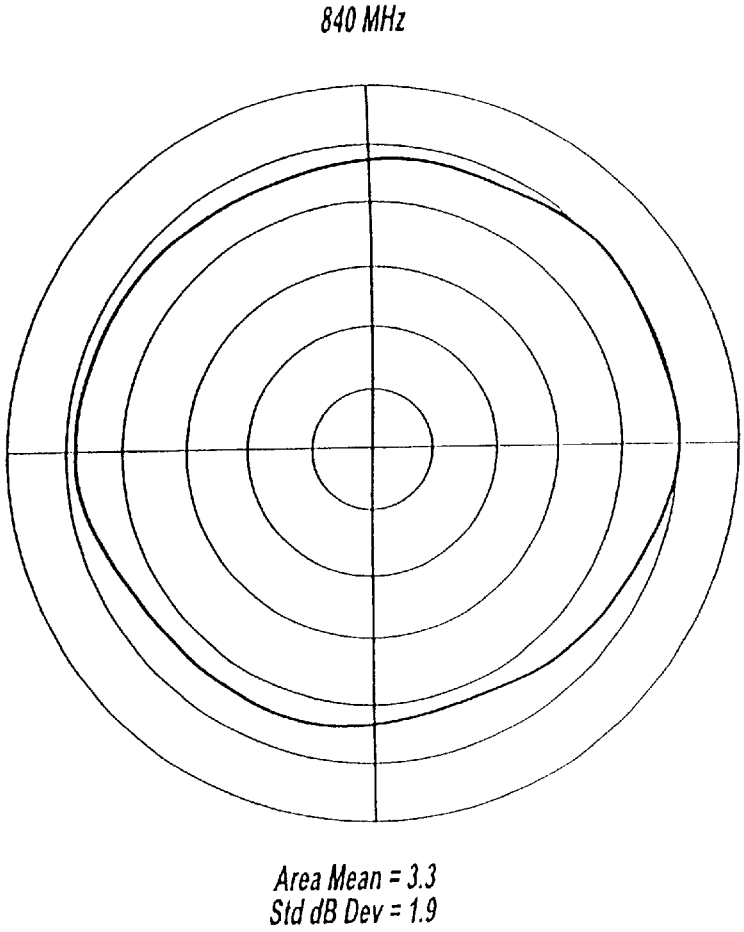
FIG. 7 is a graph showing an omni-directional radiation pattern of a printed slot antenna according to the various embodiments of the present inventions.

Printed slot antennas on thin substrates or printed circuit boards radiate almost equally into both sides of the antenna. In order to have a vertically polarized omni-directional radiation pattern as normally required by most ground-based wireless services, the multi-band antenna described above is printed on a thin vertical PCB card with a small-size ground plane. In this case, due to the finiteness of the antenna, it will exhibit an omni-directional pattern in the azimuth plane. FIG. 7 is a graph showing the radiation pattern for an 840 MHz printed slot antenna of the type being described herein. As is apparent, these printed slot antennas provide a substantially omni-directional radiation pattern. There might be a slight degradation of the pattern at the edges of the PCB card. However, the nulls normally seen at the edges of large ground planes are not present in this design. For this purpose, the size of the ground plane should be comparable to the wavelength.

It should be noted that the use of coupled parasitic elements for bandwidth enhancement has been proposed and utilized in the past, particularly, in Yagi-Uda arrays. In this type of design, the active and parasitic elements together form an array to achieve a directional radiation pattern. The spacing between the elements, however, is about a half wavelength to achieve the desired directionality. Moreover, the elements are usually linear dipoles with lengths around a half wavelength.

Single trace wound slot antenna elements are inherently narrow-band. Winding them several turns can make them omni-directional. In certain applications, such as for garage door openers or keyless remote entry devices, it is desirable to have a very narrow band, but compact, antenna that is highly omni-directional. A tightly wound slot dipole antenna vertically mounted relative to the horizon provides such an antenna.

Figure 8:
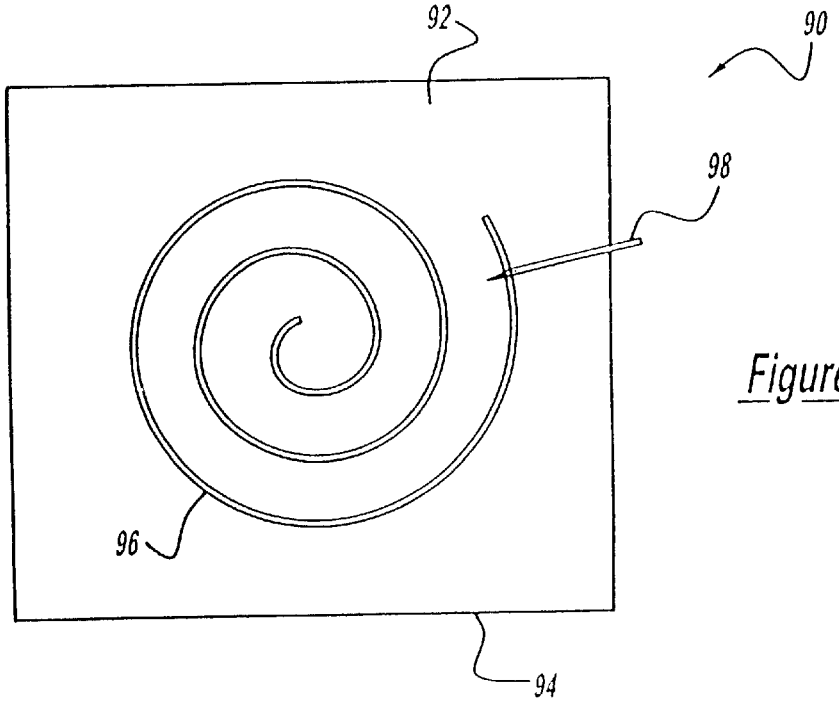
FIG. 8 is a compact UHF antenna, according to the invention, that is tuned at 390 MHz with a bandwidth of 1 MHz.

FIG. 8 is a top front view of a compact UHF antenna 90 tuned at 390 MHz with a bandwidth of 1 MHz. The antenna 90 includes a ground plane 92 patterned on a printed circuit board 94, where a wound slot element 96 is configured in the ground plane 92. The wound slot element 96 can be fed either by a coaxial feed line 98 on the same side of the printed circuit board 94 as the slot element 96 or by a microstrip feed line printed on the other side of the printed circuit board as described earlier. The antenna 90 is not a wound spiral antenna of the type known in the art because it is fed proximate an outer end of the element 96. Further, in this embodiment, the ground plane 92 is limited (small in size), and adds to the compact size of the antenna 90. The length of the element 96 determines the resonant frequency of the antenna 90. In this embodiment, the ground plane 92 is square and has side dimensions less than one-half the wavelength of the resonant frequency of the element 96. For a resonant frequency of 390 MHz, the ground plane 92 is about a 4 inch by 4 inch square in this embodiment.

Figure 9:
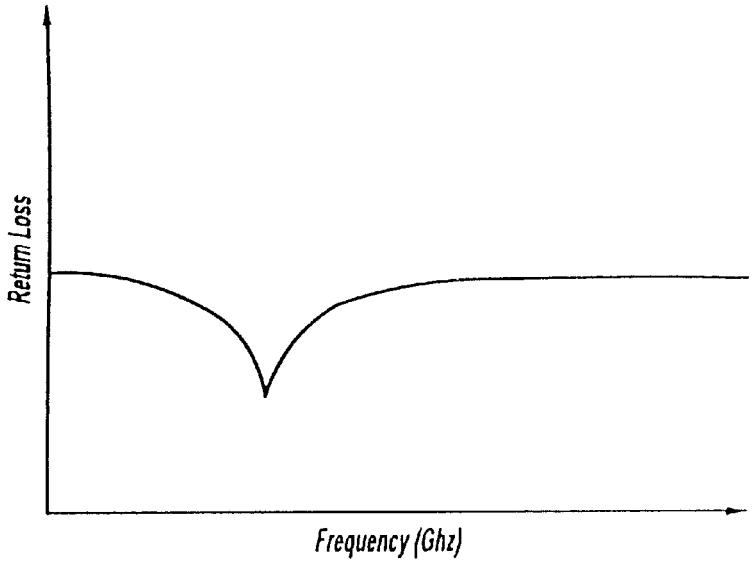
FIG. 9 is a graph showing the return loss of the antenna shown in FIG. 8.

The narrow-band antenna 90 is suitable for remote control systems, such as garage door openers and remote keyless entry devices. The sharp resonance of the antenna 90 eliminates the need for additional noise rejection band-pass filters. FIG. 9 is a graph with frequency on the horizontal axis and return loss on the vertical axis depicting the narrow band resonant frequency of the antenna 90.

Figure 10:
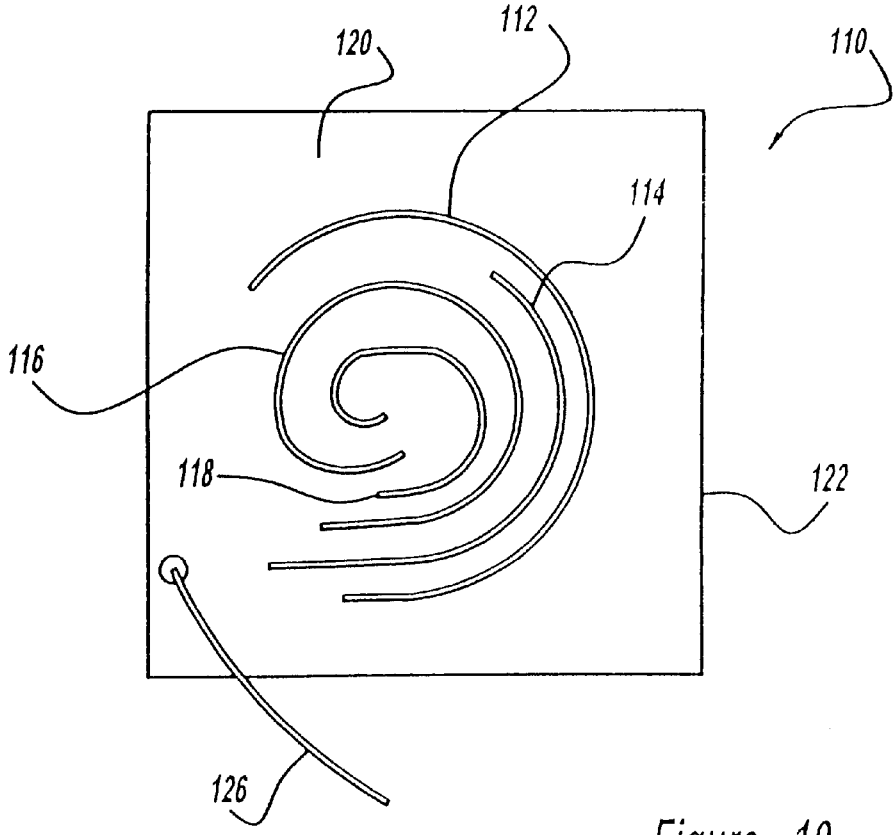
FIG. 10 is a plan view of a dual band antenna design, according to an embodiment of the present invention, that covers the AMPS band and the PCS band.

FIG. 10 shows a top view of a dual band cellular phone antenna 110 including four wound slot elements 112–118 that are etched into a ground plane 120 on a printed circuit board 122, according to another embodiment of the present invention. The elements 112–118 resonate at different frequencies that cover the AMPS band (824 MHz-894 MHz) and the PCS band (1850 MHz-1990 MHz). The dual band antenna 110 has a single cable 126 that is connected to the ground plane 120 and feeds all of the elements 112–118. The cable 126 consists of a power distribution network printed on the back of the circuit board. In this design, the two outer slot elements 112 and 114 correspond to AMPS cellular phone operation while the two inner slot elements 116 and 118 correspond to PCS operation.

Figure 11:
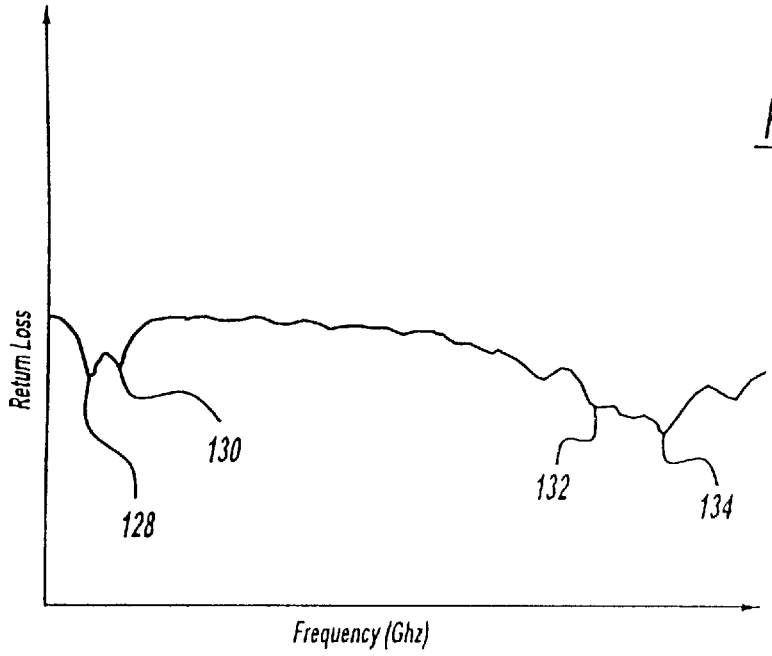
FIG. 11 is a graph showing the return loss of the antenna shown in FIG. 10.

FIG. 11 is a graph with frequency on the horizontal axis and return loss on the vertical axis showing the resonant frequencies of the elements 112–118. The combination of the resonant peaks 128 and 130 provide a wide bandwidth for the AMPS antenna applications, and the combination of the peaks 132 and 134 provide a wide bandwidth for the PCS antenna applications.

Conformality is one of the major advantages planar antennas have to offer. When these antennas are printed on thin substrates, they can conform to the contour of the application surface. In commercial applications, the antenna can be embedded on the surface of a vehicle body or into the surface of a system enclosure such as a telephone handset, a garage door opener housing, or a personal digital assistant or laptop computer cover. In military applications, the antenna can be hidden inside a platform or stretched on its surface to minimize radar visibility.

Figure 12:
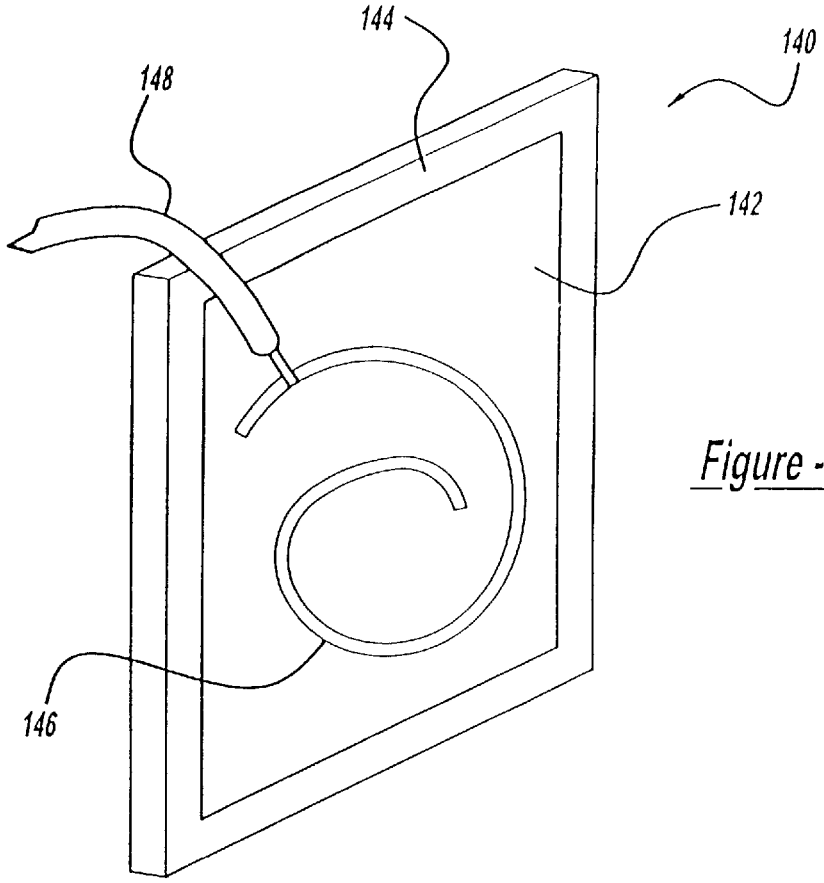
FIG. 12 is a perspective view of a sticker antenna design, according to an embodiment of the present invention.

Slot antenna designs based on this invention can be realized by stamping their layout pattern on copper tape to create a "sticker" antenna. The copper tape can then be readily mounted on a glass platform or any other surface. To depict this embodiment of the present invention, FIG. 12 shows a perspective view of an antenna 140 including a copper tape 142 adhered to a glass surface or substrate 144. A wound slot element 146 is formed in the copper tape 142, and is fed by a coaxial feed cable 148. In this case, the dielectric properties of the mounting surface have to be taken into account in the design of the trace layout.

It is possible to print the slot antenna designs discussed above on an existing non-metallic platform, such as glass or a low-loss plastic or ceramic slab. This can be done in the form of a conductive coating or metallization deposit or using adhesive pre-stamped metallic foils over the non-metallic surface. In particular, by using a high permittivity ceramic slab, the overall size of the antenna can be reduced drastically. In either case, a major requirement is to be able to feed the different antenna elements all from one side of the structure because a platform occupies the other side. According to another embodiment of the present invention, a co-planar waveguide (CPW) feed network is employed in conjunction with multi-function slot antennas. In this case, the entire antenna structure can be realized using metallization on one side of a non-metallic platform.

As discussed above, printed antennas provide low-cost, lowprofile, integrated solutions for many antenna applications. By printing different types of planar antennas on the same substrate, an integrated multi-function antenna can be achieved. According to another embodiment of the present invention, a multi-function, integrated GPS/cellular/PCS/GSM antenna is disclosed. A broad band slot spiral is used for the circularly polarized GPS antenna, which can also receive other satellite signals of the same polarization within its band. The cellular AMPS/PCS/GSM antenna is based on the compact multi-band omni-directional design discussed above, and is accommodated on the same aperture with proper spacing and topology.

Figure 13:
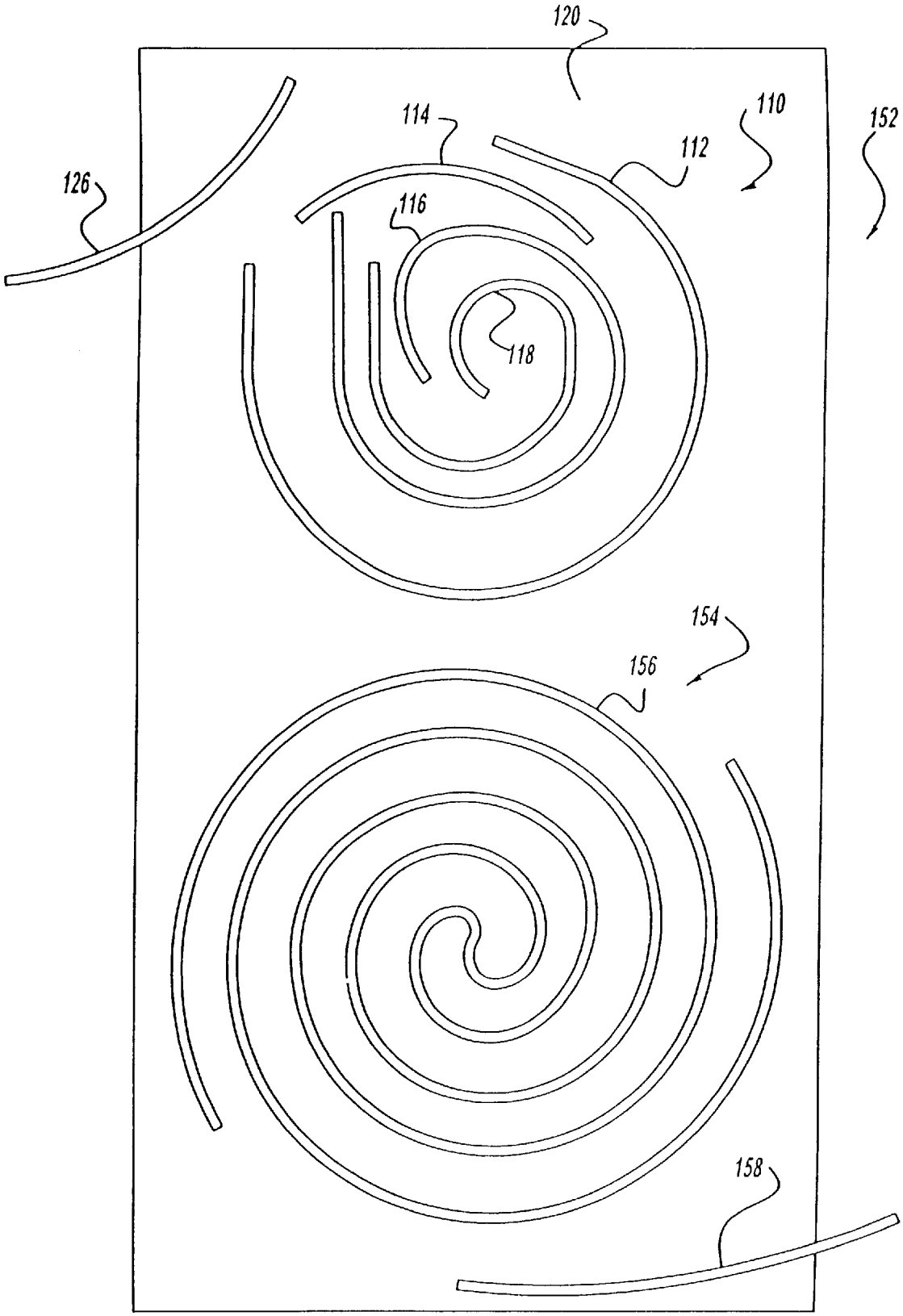
FIG. 13 is a front view of an integrated, multi-function GPS/cellular/PCS/GSM antenna, according to an embodiment of the present invention.

FIG. 13 is a front view of a multi-function, integrated GPS/cellular/PCS/GSM antenna 152 of this type. The antenna 152 includes the antenna 110 discussed above including the four slot elements 112–116 tuned to the desirably frequency band. However, in this embodiment, the ground plane 120 has been extended so that a printed GPS antenna 154 can be provided in combination with the antenna 110. In this embodiment, the GPS antenna 154 includes a spiral slot element 156 that is tuned to a particular resonant frequency band for GPS operation. The GPS antenna 154 is fed by a feedline 158 electrically connected to the ground plane 120 as shown.

Cirius and XM satellite radio systems require an antenna that not only receives circularly polarized (CP) satellite signals, but is also able to receive vertically polarized signals from ground-based stations. Therefore, an antenna for this application should have both a directional upward-looking CP radiation pattern with some gain and a vertically polarized omni-directional pattern. In accordance with the teachings of another embodiment of the present invention, the antenna design consists of a spiral slot antenna with a CP operation combined with a compact omni-directional printed antenna for the linear polarization of the type discussed above. The two antenna elements share a common aperture and are printed on the same printed circuit board. The PCB card should be oriented upright at a small angle from zenith (about 30 degrees). In this case, the vertical polarization performance will be satisfactory, while the CP antenna will exhibit a good performance due to its broad beamwidth.

In the above-mentioned multi-function integrated antenna designs, the spiral slot antenna can be replaced with any other planar antenna that provides a CP operation. One example is a cross slot antenna that is fed near the ends of two adjacent arms of the cross with proper phase difference. In particular, when a uniplanar multi-function antenna is desired, which has to be printed entirely on one side of a non-metallic platform, the present invention proposes a CPW balanced feed for the broadband spiral antenna design that is fit between the two arms of the dual-arm spiral. A CPW feed network is also designed for the omni-directional antenna for the cellular/PCS/GSM operation.

Figure 14:
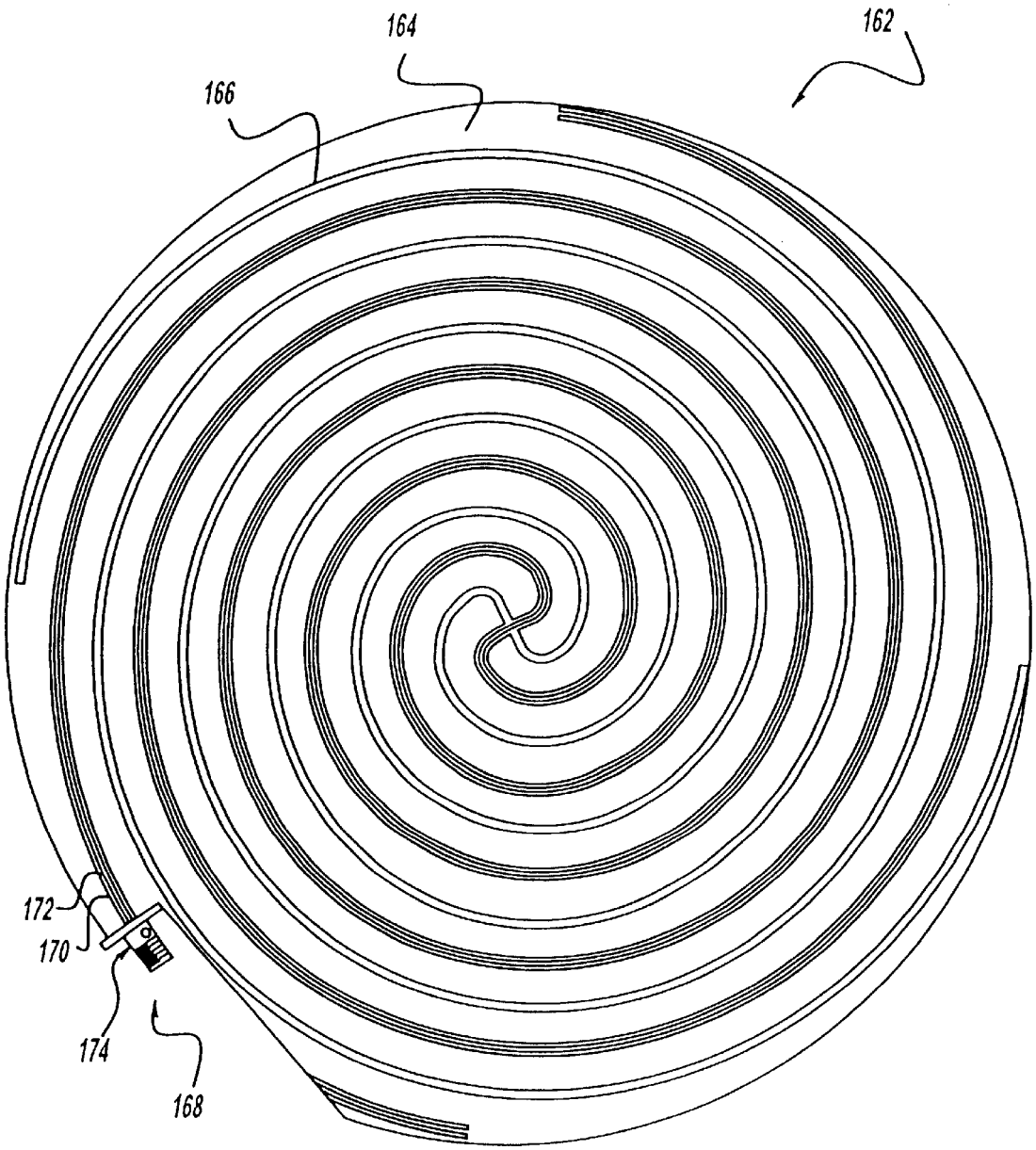
FIG. 14 is a front view of a multi-function, integrated spiral slot antenna, according to another embodiment of the present invention, that employs a CPW balanced feed.

FIG. 14 is a front view of a CPW-fed, printed spiral slot antenna 162 employing this design. The antenna 162 includes a ground plane 164 formed on one side of a PCB. A spiral slot element 166 is etched in the ground plane 164, and is of the same type as the slot element 156 discussed above. A CPW feed network 168 is provided where a spiral slot element 170 is formed in the ground plane 164 parallel to the slot element 166, as shown. A center conductor 172 is formed in the slot element 170, and is connected to an inner conductor of a coaxial connector 174, as shown. The outer conductor of the coaxial connector 174 is electrically connected to the ground plane 164. The slot element 170 and the center conductor 172 together form a balanced coplanar waveguide feed for the spiral slot element 166.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A compact omni-directional printed slot antenna comprising:

a printed circuit board;

a small-size ground plane patterned on one surface of the circuit board;

a first slot element formed in the ground plane and including a first end and a second end, said first slot element having a general curved configuration and being fed by a first antenna feed at a predetermined location proximate the first end of the first slot element; and a second slot element formed in the ground plane and including a first end and a second end, said second slot element also having a general curved configuration following the general contour of the first slot element, said second slot element being fed by a second antenna feed proximate the first end of the second slot element, wherein the first and second elements are different lengths and couple together to provide a wider bandwidth than the first or second antenna element would have alone, while maintaining an omni-directional radiation pattern.

2. The antenna according to claim 1 wherein the first antenna feed is coupled to the first slot element a predetermined distance from the first end of the first slot element and the second antenna feed is coupled to the second slot element a predetermined distance from the first end of the second slot element, wherein the first and second predetermined distances are different.

3. The antenna according to claim 1 further comprising other wound slot elements coupled to the first and second slot elements, wherein all of the slot elements are different lengths and each element resonates at a different resonant frequency to create an integrated multi-band antenna, and wherein each additional element has its own feed or is coupled electromagnetically to another element.

4. The antenna according to claim 3 wherein the antenna covers the AMPS frequency band, the GSM frequency band and the PCS frequency band.

5. The antenna according to claim 1 wherein the first and second feeds are selected from the group consisting of microstrip feeds, coaxial feeds and co-planar waveguide feeds.

6. The antenna according to claim 1 wherein the antenna is stamped on a device selected from the group consisting of a tape, a foil and a deposited conductive coating so that the antenna is readily mountable to a support platform.

7. The antenna according to claim 1 wherein the first antenna feed and the second antenna feed are branched from a common feed line.

8. A compact printed slot antenna comprising:

a printed circuit board;

a ground plane patterned on one surface of the circuit board;

a first wound slot element patterned in the ground plane to have a general curved configuration and having a first resonant frequency;

a first microstrip antenna feed patterned on a surface of the circuit board opposite from the ground plane, said first antenna feed including a first shorting via extending through the circuit board and being shorted to the ground plane proximate an outer end of the first slot element;

a second wound slot element patterned in the ground plane to have a general curved configuration following the general contour of the first slot element, said second slot element having a second resonant frequency; and a second microstrip antenna feed patterned on the surface of the printed circuit opposite to the ground plane, said second feed including a second shorting via extending through the circuit board and being shorted to the ground plane proximate an outer end of the second slot element, wherein the resonant frequencies of the first and second slot elements are different and are coupled together to provide a wider bandwidth than the first and second slot elements alone.

9. The antenna according to claim 8 wherein the first antenna feed is coupled to the first slot element a predetermined distance from the outer end of the first slot element and the second antenna feed is coupled to the second slot element a predetermined distance from the outer end of the second slot element, wherein the first and second predetermined distances are different.

10. The antenna according to claim 8 further comprising a third wound slot element patterned in the ground plane and having a general curved configuration following the contour of the first and second slot elements and a fourth wound slot element patterned in the ground plane and having a general curved configuration following the general contour of the first, second and third slot elements, wherein the resonant frequencies of the third and fourth slot elements are different and are coupled together to provide a wider bandwidth than the individual slot elements alone at different frequency bands to provide an integrated multi-band antenna.

11. The antenna according to claim 8 wherein the circuit board is mounted vertically relative to the horizon to provide an omni-directional radiation pattern with vertical polarization.

12. The antenna according to claim 10 wherein the antenna covers the AMPS frequency band, GSM frequency band and the PCS frequency band.

13. The antenna according to claim 8 wherein the antenna is stamped on a device selected from the group consisting of a tape, a foil, and a deposited conductive coating so that the antenna is readily mountable to a support platform.

14. A compact integrated multi-function printed slot antenna for providing simultaneous satellite and terrestrial operations, said antenna comprising:

a printed circuit board;

a ground plane patterned on one surface of the printed circuit board;

a first wound slot element patterned in the ground plane to have a general curved configuration;

a second wound slot element patterned in the ground plane to have a general curved configuration following the general contour of the first slot element;

a first antenna feed connected to the ground plane proximate the first and second slot elements;

a circularly polarized spiral slot antenna element patterned in the ground plane adjacent to the first and second wound slot elements; and a second antenna feed connected to the ground plane an appropriate distance and having a relative orientation to the first and second slot elements to minimize interference and maximize signal isolation between the elements.

15. The antenna according to claim 14 further comprising a third wound slot element patterned in the ground plane and having a general curved configuration following the contour of the first and second slot elements and a fourth wound slot element patterned in the ground plane and having a general curved configuration following the general contour of the first, second and third slot elements, wherein the resonant frequencies of the third and fourth slot elements are different and are coupled together to provide a wider bandwidth than the individual slot elements alone at different frequency bands, thus creating an integrated multi-band antenna, and wherein the third and fourth antenna elements are fed by the first antenna feed.

16. The antenna according to claim 14 wherein the first and second antenna feeds include a microstrip network patterned on a surface of the circuit board opposite from the ground plane.

17. The antenna according to claim 14 wherein the antenna feeds include a co-planar waveguide network patterned on the same surface of the circuit board where the ground plane and the slot elements are located to achieve an entirely uni-planar integrated multi-function printed antenna.

18. A compact printed slot antenna comprising:

a printed circuit board;

a ground plane patterned on one surface of the circuit board;

a first wound slot element patterned in the ground plane to have a general curved configuration and having a first resonant frequency;

a first co-planar waveguide network for feeding the first wound slot element, said first co-planar waveguide network being patterned on the same surface of the circuit board as the ground plane;

a second wound slot element patterned in the ground plane to have a general curved configuration following the general contour of the first slot element, said second slot element having a second resonant frequency; and a second co-planar waveguide network for feeding the second would slot element, said second co-planar waveguide network being patterned on the same surface of the circuit board as the ground plane, wherein the resonant frequencies of the first and second slot elements are different and are coupled together to provide a wider bandwidth than the first and second slot elements alone.

* * * * *

UNITED STATES PATENT AND TRADEMARK OFFICE

CERTIFICATE OF CORRECTION

PATENT NO. : 6,480,162 B2
DATED : November 12, 2002
INVENTOR(S) : Kazem F. Sabet et al.

It is certified that error appears in the above-identified patent and that said Letters Patent is hereby corrected as shown below:

Title page,
Item [54], Title, "LOW COST COMPACT OMINI-DIRECTIONAL PRINTED ANTENNA" should be -- LOW COST COMPACT OMNI-DIRECTIONAL PRINTED ANTENNA --.
Item [56], References Cited, U.S. PATENT DOCUMENTS,

| | | |
|---|---|---|
| "2,863,145 A | 12/1958 | Turner" should be |
| -- 2,863,145 A | 10/1955 | Turner --. |
| "3,031,665 A | 4/1962 | Robert-Pierre Marie" should be |
| -- 3,031,665 A | 12/1959 | Robert-Pierre Marie --. |
| "5,539,420 A | 7/1996 | Dusseux et al." should be |
| -- 5,539,420 A | 1/1996 | Dusseux et al. --. |

Column 4,
Line 33, "FIGS. 6(a)" should be -- FIG. 6(a) --.

Column 10,
Line 34, "would" should be -- wound --.

Signed and Sealed this

Sixteenth Day of August, 2005

JON W. DUDAS
*Director of the United States Patent and Trademark Office*